US012264034B2

(12) United States Patent
Murata et al.

(10) Patent No.: US 12,264,034 B2
(45) Date of Patent: Apr. 1, 2025

(54) IMAGE READING APPARATUS THAT GUIDES DOCUMENT FROM COMMON TRANSPORT ROUTE TO ONE OF CURVED TRANSPORT ROUTE AND LINEAR TRANSPORT ROUTE, BY CONTROLLING ACTION OF SWITCHING DEVICE, AND IMAGE FORMING APPARATUS

(71) Applicant: KYOCERA Document Solutions Inc., Osaka (JP)

(72) Inventors: Takuro Murata, Osaka (JP); Masayoshi Takahashi, Osaka (JP); Masahiro Nakao, Osaka (JP); Taro Kurahashi, Osaka (JP); Shunsuke Sasaki, Osaka (JP); Risa Fukuuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 184 days.

(21) Appl. No.: 18/209,615

(22) Filed: Jun. 14, 2023

(65) Prior Publication Data

US 2023/0406658 A1 Dec. 21, 2023

(30) Foreign Application Priority Data

Jun. 21, 2022 (JP) ..... 2022-099854

(51) Int. Cl.
*B65H 5/26* (2006.01)
*B65H 7/02* (2006.01)
(Continued)

(52) U.S. Cl.
CPC ..... *B65H 5/26* (2013.01); *B65H 7/02* (2013.01); *B65H 7/12* (2013.01); *B65H 29/60* (2013.01);
(Continued)

(58) Field of Classification Search
CPC ... B65H 5/26; B65H 7/02; B65H 7/12; B65H 7/125; B65H 29/58; B65H 29/60;
(Continued)

(56) References Cited

U.S. PATENT DOCUMENTS

2005/0012259 A1* 1/2005 Sano ..... B65H 9/006 271/10.01
2011/0013240 A1* 1/2011 Kobayashi ..... B65H 7/02 271/10.01
2018/0088503 A1* 3/2018 Yamauchi ..... B65H 7/20

FOREIGN PATENT DOCUMENTS

JP 2018198379 A 12/2018

* cited by examiner

*Primary Examiner* — Prasad V Gokhale
(74) *Attorney, Agent, or Firm* — IP Business Solutions, LLC.

(57) ABSTRACT

An image reading apparatus includes a document tray, a common transport route, a curved transport route, a linear transport route, a switching device, a document transport device, a first image sensor, a second image sensor, a trailing edge detector, a multi feed detector, a leading edge detector, and a controller. The controller determines a length of the document in the transport direction, on a basis of a time point that the leading edge detector has detected the leading edge of the document, a time point that the trailing edge detector has detected the trailing edge of the document, and a time point that a detection status of the multi feed detector has been switched to a non-detection state, and guides the document to the curved transport route or the linear transport route from the common transport route, according to the length of the document, by controlling the switching device.

9 Claims, 11 Drawing Sheets

(51) Int. Cl.
*B65H 7/12* (2006.01)
*B65H 29/60* (2006.01)

(52) U.S. Cl.
CPC ..... *B65H 2511/11* (2013.01); *B65H 2511/414* (2013.01); *B65H 2511/524* (2013.01); *B65H 2701/1311* (2013.01); *B65H 2701/1313* (2013.01); *B65H 2801/06* (2013.01)

(58) Field of Classification Search
CPC ..... B65H 2511/11; B65H 2511/414; B65H 2511/524; B65H 2701/1311; B65H 2701/1313; B65H 2801/06
See application file for complete search history.

IMAGE READING APPARATUS THAT GUIDES DOCUMENT FROM COMMON TRANSPORT ROUTE TO ONE OF CURVED TRANSPORT ROUTE AND LINEAR TRANSPORT ROUTE, BY CONTROLLING ACTION OF SWITCHING DEVICE, AND IMAGE FORMING APPARATUS

INCORPORATION BY REFERENCE

This application claims priority to Japanese Patent Application No. 2022-099854 filed on Jun. 21, 2022, the entire contents of which are incorporated by reference herein.

BACKGROUND

The present disclosure relates to an image reading apparatus that reads the image of a document while transporting the same, and an image forming apparatus including such image reading apparatus. In particular, the disclosure relates to a technique to distinctively utilize a curved transport route and a linear transport route, on each of which the document is transported.

An image reading apparatus reads an image of a document placed on a platen glass, or of a document drawn out and delivered from a document tray. For example, an image reading apparatus is generally known that is configured to transport the document drawn out from the document tray along a curved transport route or a linear transport route, and read the image of the document being transported along the curved transport route or the linear transport route. The curved transport route is suitable for transporting a document made of a flexibly bendable thin sheet. The linear transport route is suitable for transporting a document made of a thick sheet such as a name card or the like, which is difficult to bend.

The image reading apparatus configured as above includes, for example, a first transport route, a second transport route branched from a branch point of the first transport route, a thickness sensor that detects the thickness of the document, the thickness sensor being located upstream of the branch point in a document transport direction, a switching device provided at the branch point, and a controller that switches the posture of the switching device according to the thickness of the document detected by the thickness sensor, to thereby guide the document to the first transport route or the second transport route. In the known image reading apparatus configured as above, the first transport route is curved at a position downstream of the branch point, in the document transport direction. The second transport route extends linearly, in the section downstream of the branch point, in the document transport direction. When the thickness of the document detected by the thickness sensor is thicker than a predetermined level, and therefore the document is considerably stiff, the switching device guides the document to the second transport route, which is linear.

SUMMARY

The disclosure proposes further improvement of the foregoing techniques.

In an aspect, the disclosure provides an image reading apparatus including a document tray, a common transport route, a curved transport route, a linear transport route, a switching device, a document transport device, a first image sensor, a second image sensor, a trailing edge detector, a multi feed detector, a leading edge detector, and a controller. The curved transport route and the linear transport route are branched from the common transport route. The switching device is provided at a branch point between the curved transport route and the linear transport route. The document transport device draws out a document from the document tray on which the document is placed, transports the document along the common transport route, and delivers the document transported along the common transport route to one of the curved transport route and the linear transport route, with the switching device. The first image sensor reads an image of the document being transported along the curved transport route. The second image sensor reads an image of the document being transported along the linear transport route. The trailing edge detector is provided on the common transport route, to detect a trailing edge of the document. The multi feed detector is provided on the common transport route, to detect whether multi feed of documents is occurring. The leading edge detector is provided on the common transport route, at a position downstream of the trailing edge detector and the multi feed detector in a document transport direction, to detect a leading edge of the document. The controller includes a processor, and determines, when the processor executes a control program, a length of the document in the transport direction, on a basis of a detection time point that the leading edge detector has detected the leading edge of the document, a detection time point that the trailing edge detector has detected the trailing edge of the document, and a non-detection time point that a detection status of the multi feed detector has been switched to a non-detection state, and guides the document to one of the curved transport route and the linear transport route from the common transport route, according to the length of the document in the transport direction, by controlling an action of the switching device.

In another aspect, the disclosure provides an image forming apparatus including the foregoing image reading apparatus, and an image forming device. The image forming device forms the image of the document read by the image reading apparatus, on a recording sheet.

DETAILED DESCRIPTION

Figure 1:
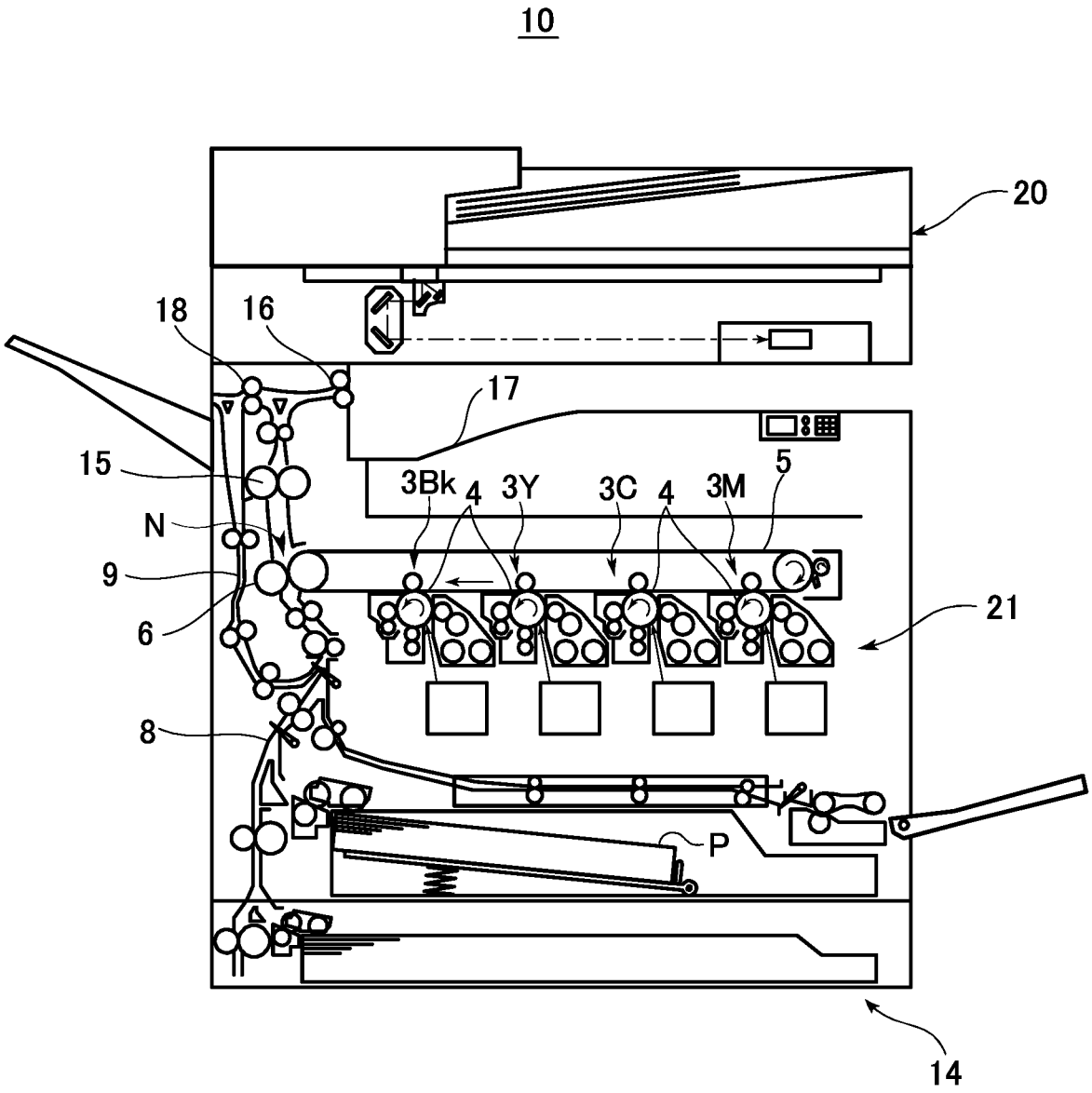
FIG. 1 is a cross-sectional view showing an image forming apparatus.

Hereafter, an embodiment of the disclosure will be described, with reference to the drawings. FIG. 1 is a cross-sectional view showing an image forming apparatus 10 according to the embodiment of the disclosure. As shown in FIG. 1, the image forming apparatus 10 includes an image reading apparatus 20 and an image forming device 21.

The image reading apparatus 20 includes an image sensor (CCD sensor or contact image sensor) that optically reads an image of a document. The image reading apparatus 20 converts an analog output from the image sensor into a digital signal, and generates image data representing the image of the document.

The image forming device 21 serves to print the image represented by the image data, on a recording sheet. The image forming device 21 includes an image forming unit 3M for magenta, an image forming unit 3C for cyan, an image forming unit 3Y for yellow, and an image forming unit 3Bk for black. In each of the image forming units 3M, 3C, 3Y, and 3Bk, the surface of a photoconductor drum 4 is uniformly charged and exposed, to thereby form an electrostatic latent image on the surface of the photoconductor drum 4, and then the electrostatic latent image on the surface of the photoconductor drum 4 is developed into a toner image, which is transferred to an intermediate transfer belt 5. As result, a colored toner image is formed on the intermediate transfer belt 5. The colored toner image is transferred, as secondary transfer, to the recording sheet P transported from a sheet feeding device 14 along a first transport route 8, at a nip region N between the intermediate transfer belt 5 and a secondary transfer roller 6.

A fixing device 15 heats and presses the recording sheet P, to fix the toner image onto the recording sheet P, by thermal compression. A delivery roller 16 delivers the recording sheet P to an output tray 17.

When the image of the document is to be also printed on the back face of the recording sheet P, the image forming apparatus 10 performs switchback transport, including transporting the recording sheet P to the delivery roller 16 communicating with the output tray 17, stopping the delivery roller 16 once, and causing the delivery roller 16 to rotate reversely. The image forming apparatus 10 returns the recording sheet P to the first transport route 8, from a transport roller 18 through a second transport route 9, thereby reversing the front and back faces of the recording sheet P. Then the image forming apparatus 10 causes the image forming device 21 to form an image of the document on the back face of the recording sheet P, and delivers the recording sheet P to the output tray 17, through the delivery roller 16.

Figure 2:
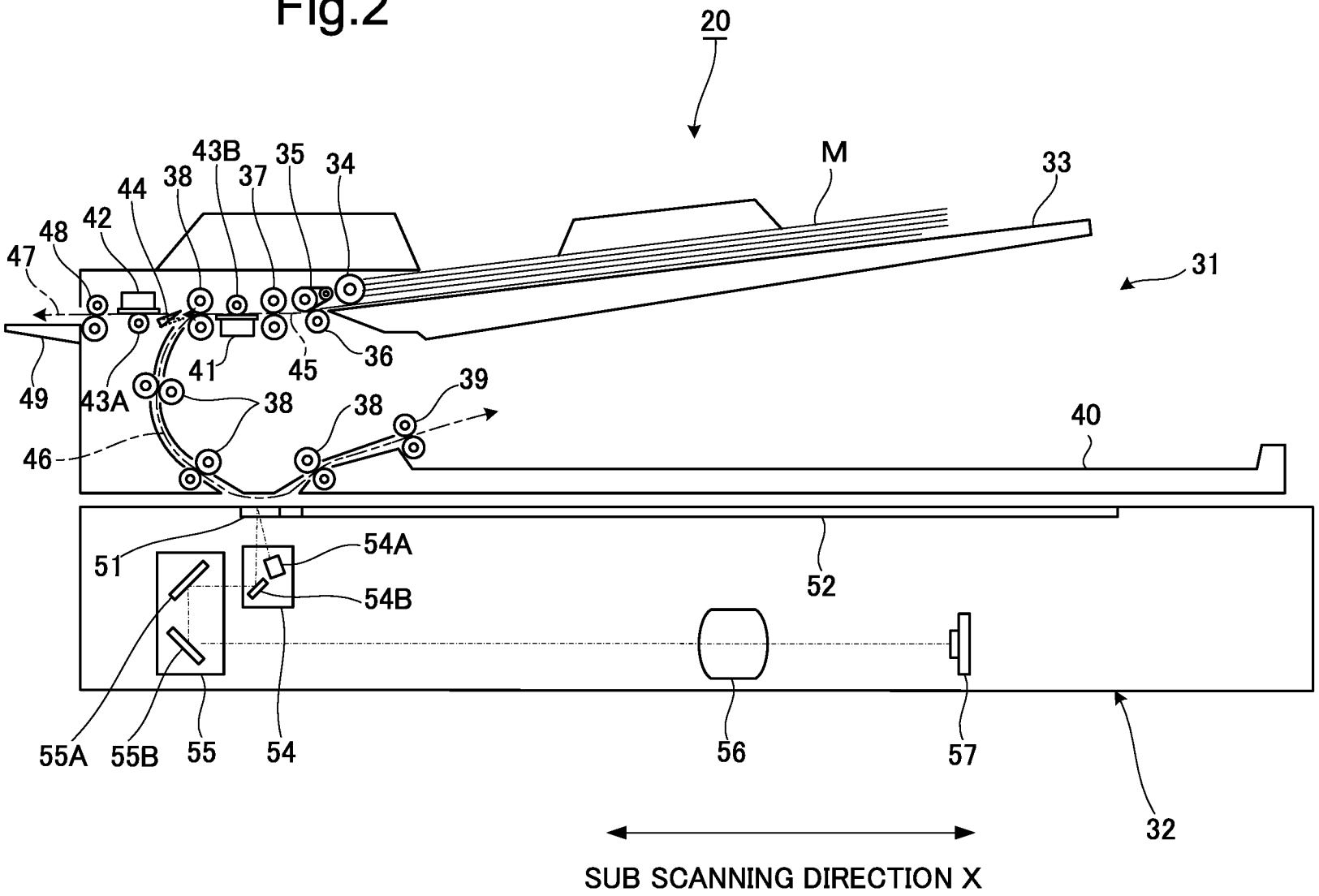
FIG. 2 is a cross-sectional view showing an image reading apparatus.
Figure 3:
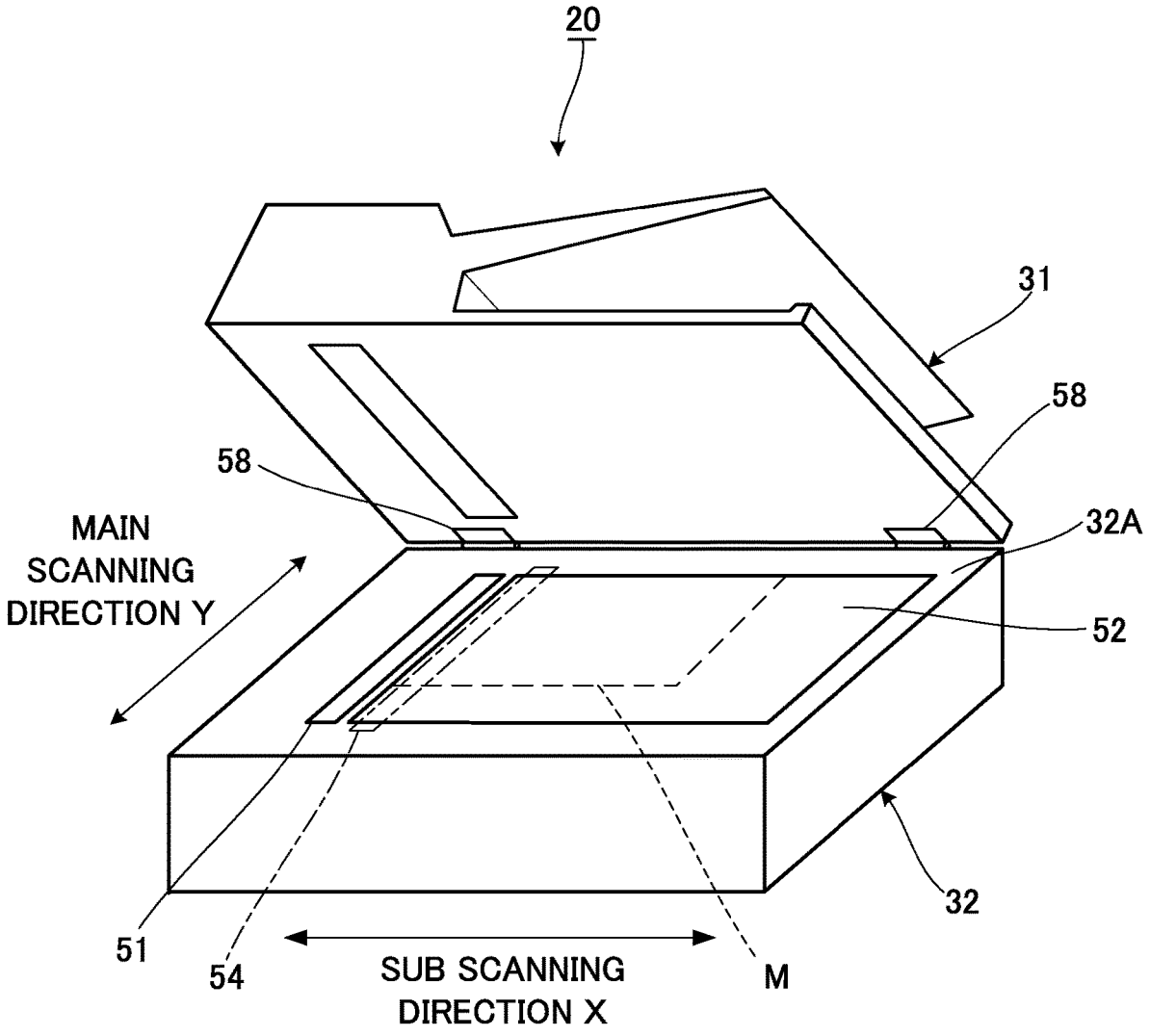
FIG. 3 is a perspective view showing the appearance of the image reading apparatus.

Hereunder, the image reading apparatus 20 will be described. FIG. 2 is a cross-sectional view showing the image reading apparatus 20. FIG. 3 is a perspective view showing the appearance of the image reading apparatus 20. FIG. 3 illustrates the state where the document transport device 31 is open.

As shown in FIG. 2 and FIG. 3, the image reading apparatus 20 includes a document transport device 31 and a reading device 32. The document transport device 31 includes a document tray 33, a feeding roller 34, a transport belt 35, a regulating roller 36, a resist roller 37, a plurality of transport rollers 38, a first discharge roller 39, a first discharge tray a first contact image sensor (hereinafter, first CIS) 41, a second contact image sensor (hereinafter, second CIS) 42, a second discharge roller 48, and a second discharge tray 49.

In the document transport device 31, when a document M is placed on the document tray 33, the feeding roller 34 draws out the document M from the document tray 33. The document M is delivered to a common transport route 45, through between the transport belt 35 and the regulating roller 36. Then the document M is transported, either along a curved transport route 46, or a linear transport route 47.

The curved transport route 46 is suitable for transporting the document M elongate in the transport direction, and formed of a flexibly bendable, thin sheet. The linear transport route 47 is suitable for transporting the document M short in the transport direction, and formed of a thick sheet difficult to bend.

On the linear transport route 47, a shading roller 43A and the second discharge roller 48, serving as transport rollers for feeding the document M, are located with a predetermined first clearance therebetween, defined in the document transport direction. Here, the feeding roller 34, the resist roller 37, a shading roller 43B, the transport roller 38, and the shading roller 43A are aligned with the first clearance between each other, in the document transport direction. The shading roller 43A is opposed to the second CIS 42. The shading roller 43B is opposed to the first CIS 41.

On the curved transport route 46, the plurality of transport rollers 38 and the first discharge roller 39, serving as the transport rollers for feeding the document M, are located with a second clearance between each other in the document transport direction, the second clearance being wider than the first clearance.

Here, the first clearance between each pair of the rollers adjacent to each other does not have to be the same, provided that the first clearance is narrower than the narrowest one of the second clearances. Likewise, the second clearance between each pair of the rollers adjacent to each other does not have to be the same, provided that the second clearance is wider than the widest one of the first clearances.

A switching claw 44 is provided at the branch point between the curved transport route 46 and the linear transport route 47. The shaft of the switching claw 44 attached to the left end thereof is made to reciprocatively rotate over a predetermined range, by an actuator. Accordingly, the distal end portion of the switching claw 44 is oriented obliquely upward or in the horizontal direction. When the distal end portion of the switching claw 44 is oriented obliquely upward, the document M is guided to the curved transport route 46, from the common transport route 45. When the distal end portion of the switching claw 44 is oriented in the horizontal direction, the document M is guided to the linear transport route 47, from the common transport route 45.

Through the common transport route 45, the document M is transported from the resist roller 37, through between the first CIS 41 and the shading roller 43B, and reaches the switching claw 44.

Through the curved transport route 46, the document M is guided downward by the switching claw 44, and transported to a first platen glass 51. The document M passes over the first platen glass 51, and is discharged to the first discharge tray 40, by the first discharge roller 39.

Through the linear transport route 47, the document M is guided in the horizontal direction by the switching claw 44, and transported through between the second CIS 42 and the shading roller 43A. Then the document M is discharged to the second discharge tray 49, by the second discharge roller 48.

Figure 4:
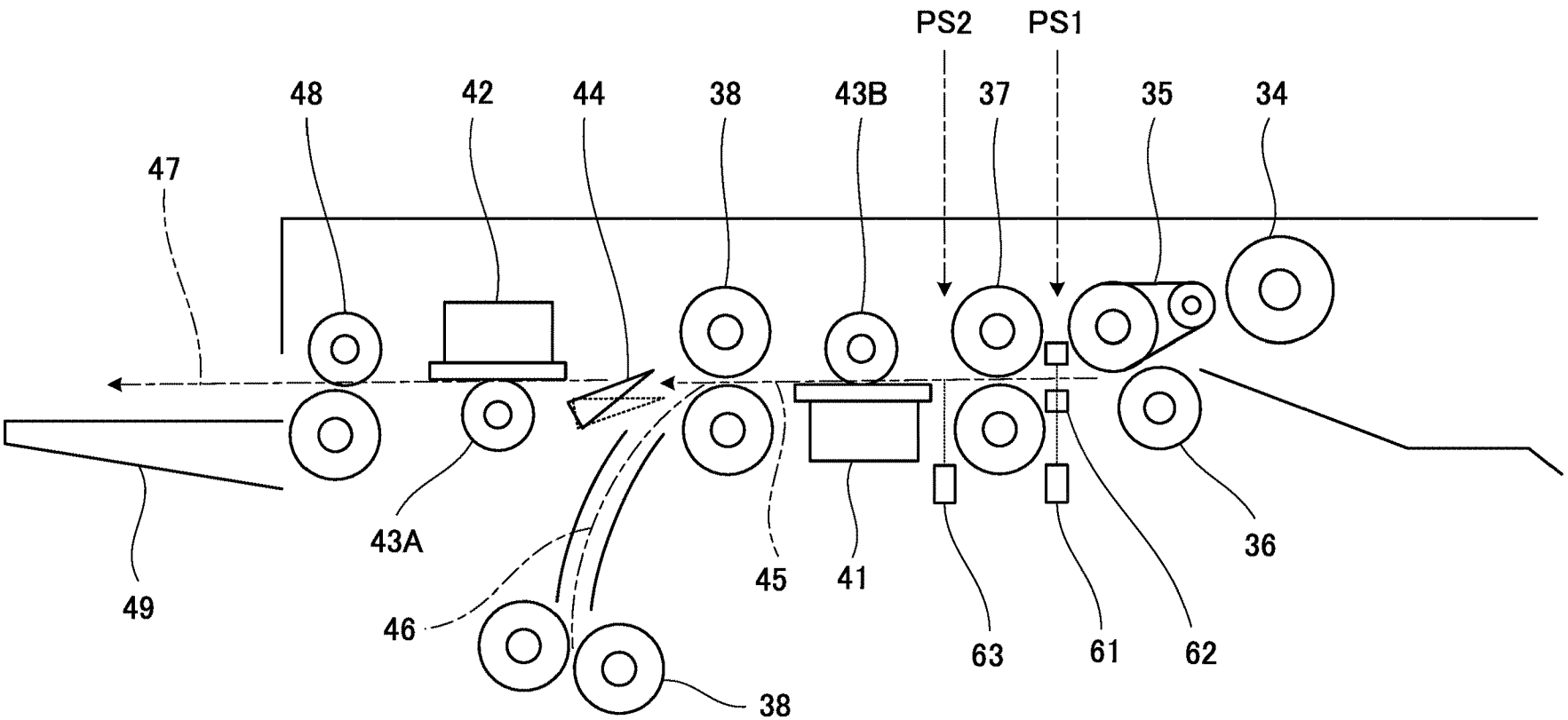
FIG. 4 is an enlarged schematic drawing showing a common transport route and related parts.

FIG. 4 is an enlarged schematic drawing showing the common transport route 45 and the related parts, in the document transport device 31. As shown in FIG. 4, on the common transport route 45, a trailing edge sensor 61 and a multi feed sensor 62 are provided, at the position downstream of the transport belt 35 in the transport direction of the document M, but upstream of the resist roller 37 in the document transport direction. In addition, on the common transport route 45, a CIS position sensor 63 is provided at the position downstream of the resist roller 37 in the document transport direction, but upstream of the first CIS 41 in the document transport direction.

The trailing edge sensor 61 is, for example, a reflective or transmissive optical sensor, including a light emitting element and a photodetector. The trailing edge sensor 61 detects the trailing edge of the document M passing a position PS1 between the transport belt 35 and the resist roller 37.

The CIS position sensor 63 is, for example, a reflective or transmissive optical sensor, including a light emitting element and a photodetector. The CIS position sensor 63 detects the leading edge of the document M passing a position PS2 between the resist roller 37 and the first CIS 41.

Figure 5A:
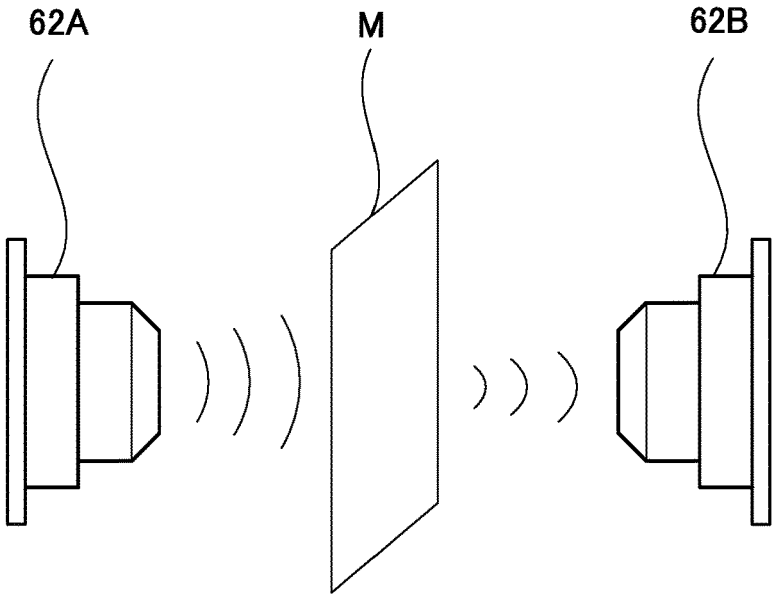
FIG. 5A is a schematic drawing showing a document passing between a transmitter and a receiver of a multi feed sensor.
Figure 5B:
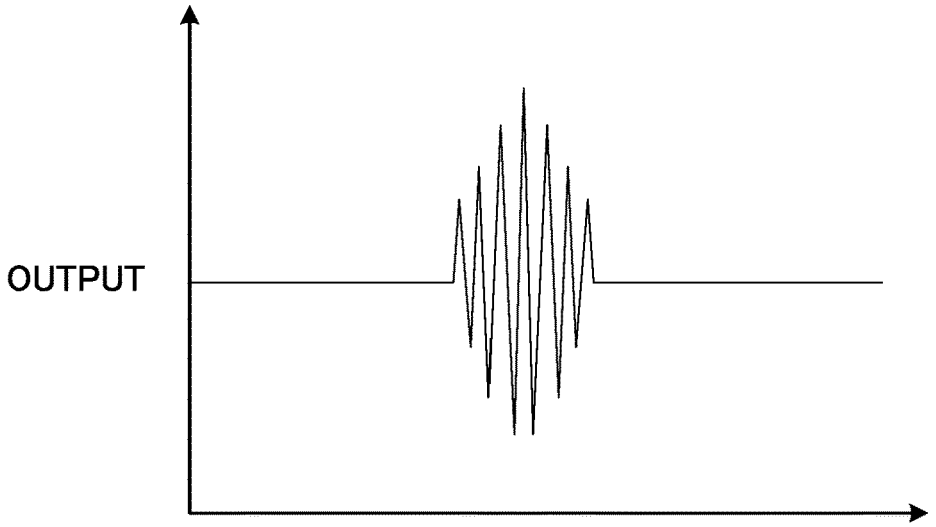
FIG. 5B is a schematic diagram showing a signal outputted from the receiver when multi feed is not occurring.
Figure 5C:
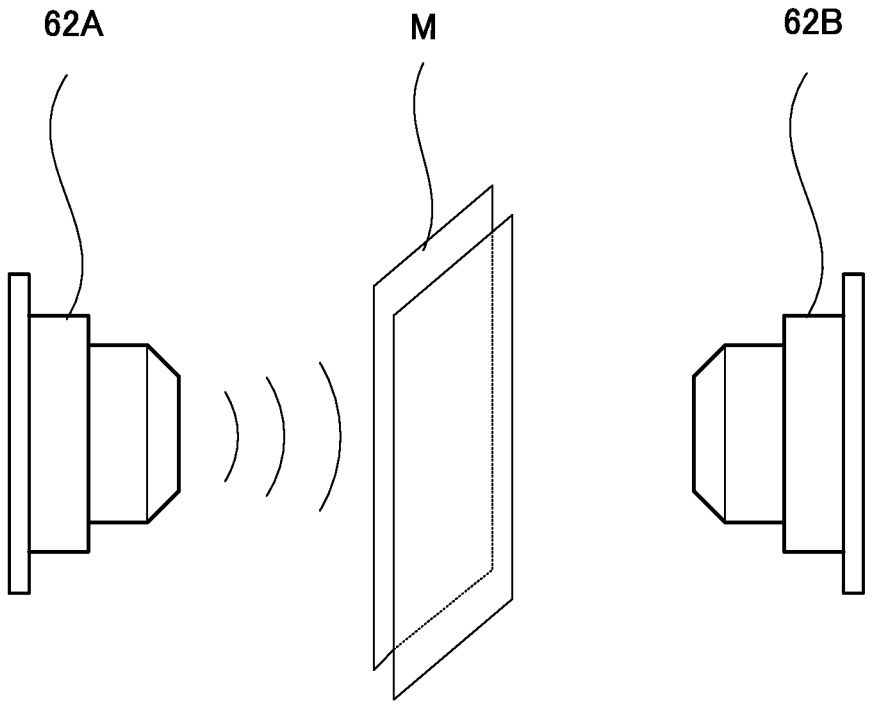
FIG. 5C is a schematic drawing showing two documents passing between the transmitter and the receiver of the multi feed sensor.
Figure 5D:
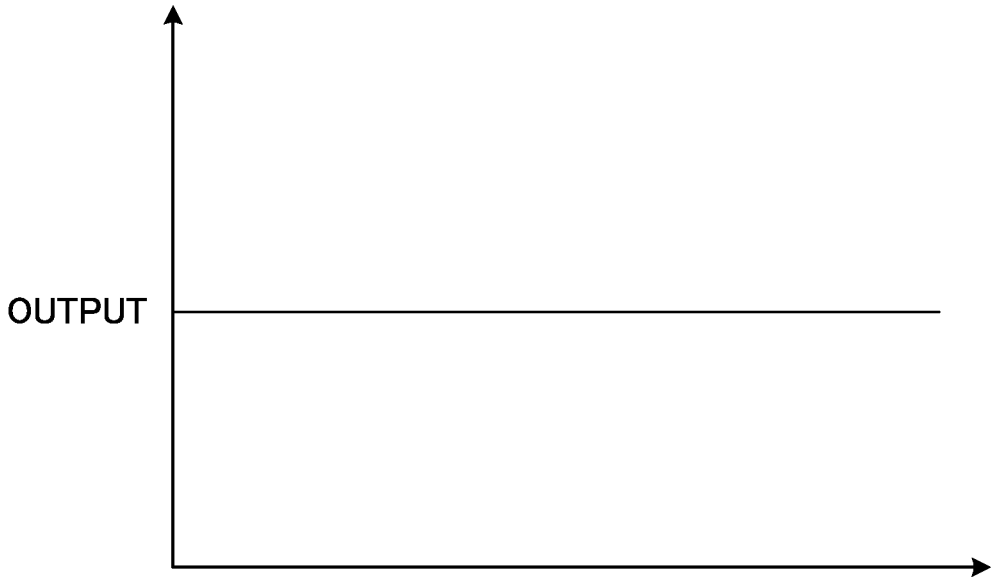
FIG. 5D is a schematic diagram showing a signal outputted from the receiver when multi feed is occurring.

Referring to FIG. 5A, the multi feed sensor 62 includes a transmitter 62A that emits ultrasonic wave to the document, and a receiver 62B that receives the ultrasonic wave transmitted through the document. The multi feed sensor 62 detects the multi feed of the documents, at the detection position PS1 where the trailing edge sensor 61 detects the trailing edge of the document. The transmitter 62A and the receiver 62B of the multi feed sensor 62 are opposed to each other. When a single sheet of the document M passes through between the transmitter 62A and the receiver 62B, the ultrasonic wave emitted from the transmitter 62A is received by the receiver 62B, via the single sheet of the document M. Accordingly, as shown in FIG. 5B, the output of the receiver 62B varies, and reaches a level equal to or higher than a prespecified multi feed threshold. In contrast, when two sheets of documents M overlaid on each other pass through between the transmitter 62A and the receiver 62B, as shown in FIG. 5C, the ultrasonic wave emitted from the transmitter 62A is blocked by the two documents M, and can barely be received by the receiver 62B. Therefore, the output of the receiver 62B barely varies, and remains below the multi feed threshold, as shown in FIG. 5D.

As shown in FIG. 2 and FIG. 3, the reading device 32 includes the first platen glass 51, a second platen glass 52, a carriage 54, an optical unit 55, a condenser lens 56, and a CCD sensor 57.

In the reading device 32, the carriage 54 includes a light source 54A that emits light to the document, and a mirror 54B that reflects the light reflected by the document M. The optical unit 55 includes a mirror 55A and a mirror 55B. The mirror 55A reflects the light reflected by the mirror 54B of the carriage 54, generally vertically downward. The mirror reflects the light reflected by the mirror 55A generally horizontally, thus guiding the light to the CCD sensor 57 through the condenser lens 56.

The carriage 54 and the optical unit 55 are configured to reciprocate, along a rail, in a sub scanning direction X orthogonal to a main scanning direction Y. The carriage 54 and the optical unit 55 are driven by a known drive mechanism based on a stepping motor, so as to move in the sub scanning direction X, maintaining a predetermined speed relation.

Two hinges 58 are provided with a spacing between each other, on one end portion of the top face 32A of the reading device 32. These hinges 58 serve to openably support the document transport device 31. Such a configuration enables a user to open or close the document transport device 31.

The controller 29 of the image reading apparatus 20 is configured to switch between a first mode for reading the image of the document M placed on the second platen glass 52, and a second mode for reading the image of the document M, while transporting the document M with the document transport device 31. The image reading apparatus 20 includes, for example, a first sensor for detecting the document M placed on the second platen glass 52, and a second sensor for detecting the document M placed on the document tray 33 of the document transport device 31. The controller 29 sets the first mode, when the first sensor detects the document M, and sets the second mode, when the second sensor detects the document M.

In the first mode, the user opens the document transport device 31, thereby exposing the second platen glass 52 of the reading device 32, and places the document M on the second platen glass 52. Then the user closes the document transport device 31, thereby holding the document M placed on the second platen glass 52, with the document transport device 31. The controller 29 causes the reading device 32 to emit the light of the light source 54A of the carriage 54, to the surface of the document M through the second platen glass 52, while moving the carriage 54 and the optical unit 55 in the sub scanning direction X, maintaining the predetermined speed relation between each other. The light reflected by the surface of the document M is reflected by the mirror 54B of the carriage 54. The light reflected by the mirror 54B is reflected by the mirror 55A and the mirror 55B of the optical unit 55, thus to be incident upon the CCD sensor 57, through the condenser lens 56. The controller 29 causes the CCD sensor 57 to repeatedly read the image on the surface of the document M, in the main scanning direction Y (orthogonal to the sub scanning direction X).

In the second mode, the controller 29 causes the feeding roller 34 of the document transport device 31 to draw out the document M placed on the document tray 33, with the document transport device 31 closed, and transports the document M along the common transport route 45, and one of the curved transport route 46 and the linear transport route 47.

When the document M is to be transported along the common transport route 45 and the curved transport route 46, the controller 29 transports the document M through between the first CIS 41 and the shading roller 43B, from the resist roller 37, as described above. Then the controller 29 causes the document M to pass over the first platen glass 51, and to be discharged to the first discharge tray 40. The controller 29 causes the reading device 32 to set the carriage 54 and the optical unit 55 at respective predetermined positions on the lower side of the first platen glass 51, and to emit the light of the light source 54A of the carriage 54, to the surface of the document M, through the first platen glass 51. The light reflected by the surface of the document M is sequentially reflected by the mirrors 54B, 55A, and 55B, thus to be incident upon the CCD sensor 57, through the condenser lens 56. The controller 29 causes the CCD sensor 57 to repeatedly read the image on the surface of the document M, in the main scanning direction Y.

When the document M is to be transported along the common transport route 45 and the linear transport route 47, the controller 29 transports the document M through between the first CIS 41 and the shading roller 43B, from the resist roller 37, as described above. Then the controller 29 causes the document M to pass through between the second CIS 42 and the shading roller 43A, and to be discharged to the second discharge tray 49. The controller 29 causes the second CIS 42 to read the image on the surface of the document M, passing through between the second CIS 42 and the shading roller 43A.

When both sides of the document M are to be read in the second mode, the controller 29 not only causes the reading device 32 or the second CIS 42 to read the image on the front face of the document M, but also causes the first CIS 41 to read the image on the back face of the document M, passing through between the first CIS 41 and the shading roller 43B.

Figure 6:
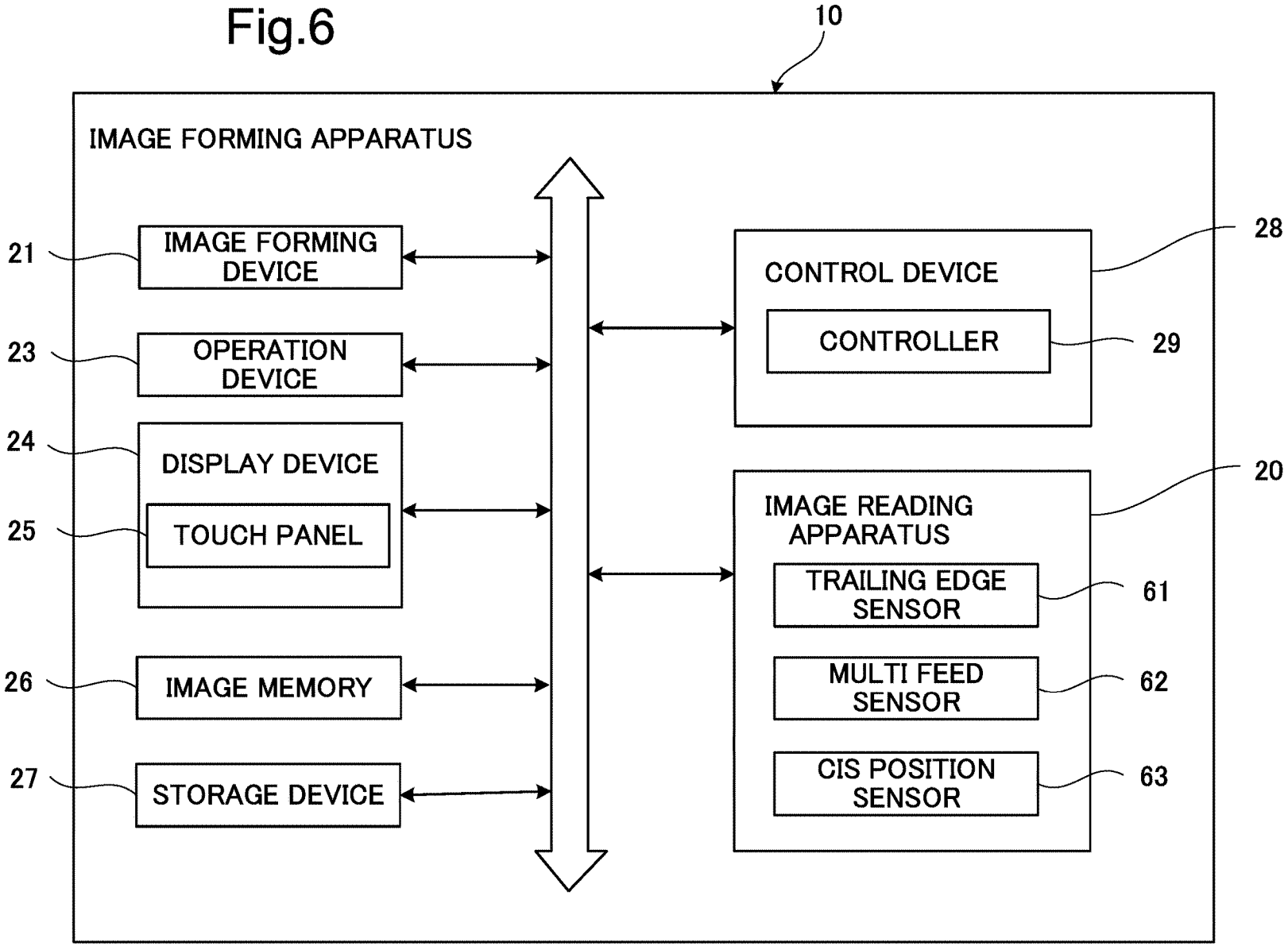
FIG. 6 is a functional block diagram showing an essential internal configuration of the image forming apparatus.

FIG. 6 is a functional block diagram showing an internal configuration of the image forming apparatus 10. As shown in FIG. 6, the image forming apparatus 10 includes the image reading apparatus 20, the image forming device 21, an operation device 23, a display device 24, a touch panel 25, an image memory 26, a storage device 27, and a control device 28. The mentioned components are configured to transmit and receive data and signals to and from each other, via a bus.

The operation device 23 includes physical keys such as a tenkey, an enter key, and a start key. The display device 24 is, for example, constituted of a liquid crystal display (LCD) or an organic light-emitting diode (OLED) display. The operation device 23 receives inputs of various instructions from the user.

The touch panel 25 is overlaid on the screen of the display device 24. The touch panel 25 is based on a resistive film or electrostatic capacitance. The touch panel 25 detects a contact (touch) of the user's finger made thereon, along with the touched position, and outputs a detection signal indicating the coordinate of the touched position, to the controller 29 of the control device 28.

The image memory 26 is for temporarily storing the image data representing the image of the document M, read by the CCD sensor 57, the first CIS 41, or the second CIS 42 of the image reading apparatus 20.

The storage device 27 is a large-capacity storage device such as a solid-state drive (SSD) or a hard disk drive (HDD). The storage device 27 contains various application programs and various types of data.

The control device 28 includes a processor, a random-access memory (RAM), a read-only memory (ROM), and so forth. The processor is, for example, a central processing unit (CPU), an application specific integrated circuit (ASIC), or a micro processing unit (MPU). The control device 28 serves as the controller 29, when the processor executes a control program stored in the ROM or the storage device 27.

The controller 29 executes overall control of the image forming apparatus 10. The controller 29 is connected to the image reading apparatus 20, the image forming device 21, the operation device 23, the display device 24, the touch panel 25, the image memory 26, and the storage device 27. The controller 29 controls the operation of the components cited above, and transmits and receives signals and data to and from those components.

The controller 29 serves as a processing device that executes various processings necessary for the image forming job by the image forming apparatus 10. The controller 29 accepts instructions to execute the operation, on the basis of a detection signal outputted from the touch panel 25, or an operation of the user performed on the physical key of the operation device 23. For example, the controller 29 accepts a user's touch operation made through the touch panel 25, on a graphical user interface (GUI) displayed on the screen of the display device 24. The controller 29 also controls the displaying operation of the display device 24.

When the trailing edge sensor 61 detects the trailing edge of the document M at the position PS1 in the document transport device 31, the controller 29 receives a detection signal outputted from the trailing edge sensor 61. When the CIS position sensor 63 detects the leading edge of the document M at the position PS2 in the document transport device 31, the controller 29 receives a detection signal outputted from the CIS position sensor 63. The controller 29 causes the first CIS 41 to start reading the image on the back face of the document M, in accordance with the time point that the leading edge of the document M has been detected. When the multi feed sensor 62 detects multi feed of the documents M at the position PS1, the controller 29 receives a detection signal outputted from the multi feed sensor 62.

The controller 29 controls the motor, the actuator, and the clutch for driving the feeding roller 34, the transport belt 35, the resist roller 37, the transport rollers 38, the shading roller 43, the first discharge roller 39, the second discharge roller 48, and the switching claw 44 of the document transport device 31, thereby operating these components. Through such operation, the controller 29 causes the document M to be drawn out from the document tray 33, and transported along the common transport route 45, and one of the curved transport route 46 and the linear transport route 47.

In the image forming apparatus 10, when the user places the document on the second platen glass 52 of the reading device 32, the first sensor detects the document M on the second platen glass 52, so that the controller 29 sets the first mode. When the user presses down the start key on the operation device 23 in such a situation, the controller 29 causes the CCD sensor 57 to read the image of the document M on the second platen glass 52, and stores the image data representing the image of the document M, in the image memory 26. Then the controller 29 causes the image forming device 21 to form the image of the document M represented by the image data, on the recording sheet P.

In contrast, when the user places the document M on the document tray 33 of the document transport device 31, the second sensor detects the document M on the document tray 33, so that the controller 29 sets the second mode.

When the user presses down the start key on the operation device 23 in such a situation, the controller 29 controls the document transport device 31, so as to cause the feeding roller 34 to draw out the document M from the document tray 33, and to deliver the document M to the common transport route 45, through between the transport belt 35 and the regulating roller 36.

Figure 7A:
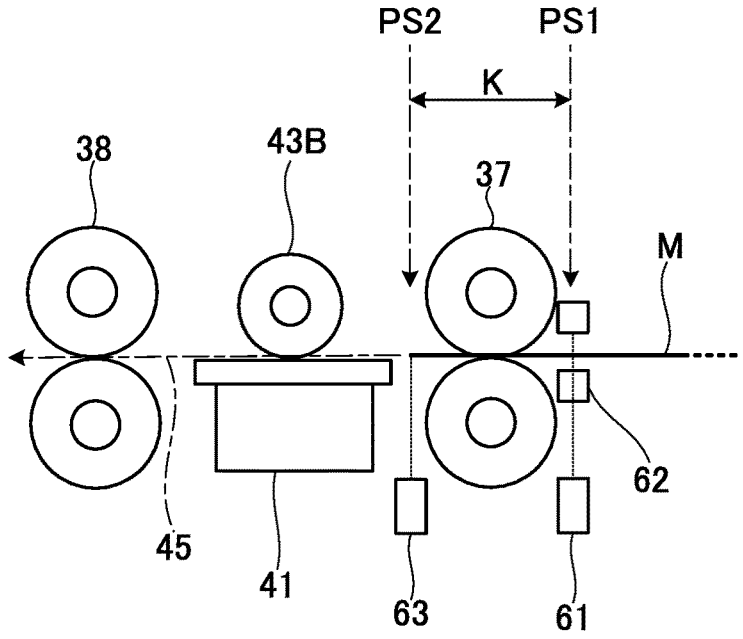
FIG. 7A is a schematic diagram showing a state where the leading edge of the document is detected, on the common transport route.
Figure 7B:
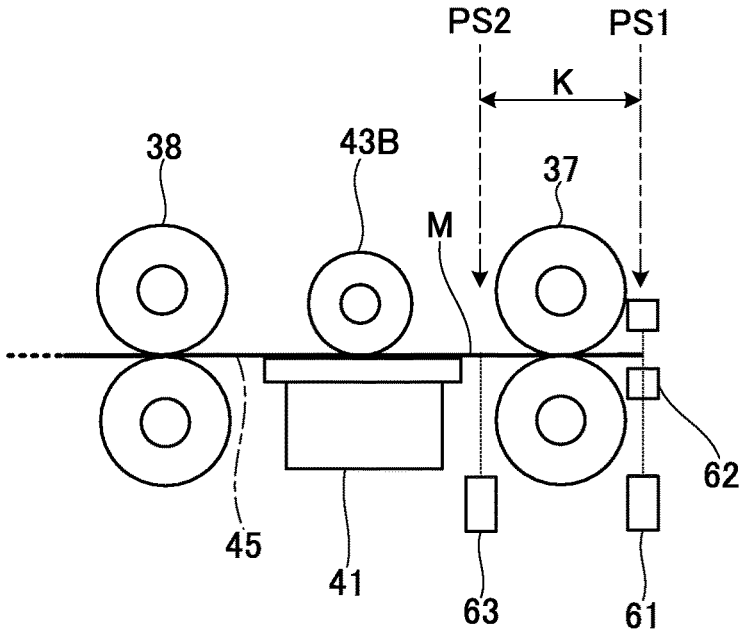
FIG. 7B is a schematic diagram showing a state where the trailing edge of the document is detected, on the common transport route.

When the document M is transported along the common transport route 45, the leading edge of the document M in the document transport direction (hereinafter, simply "leading edge") reaches the position PS2 as shown in FIG. 7A, and the CIS position sensor 63 detects the leading edge of the document M. Then when the trailing edge of the document M in the document transport direction (hereinafter, simply "trailing edge") passes the position PS1 as shown in FIG. 7B, the trailing edge sensor 61 detects the trailing edge of the document M. While the document M is passing over the position PS1, the multi feed sensor 62 detects whether the multi feed of the documents M is occurring.

When the CIS position sensor 63 detects the leading edge of the document M, the controller 29 identifies a detection time point T1 that the leading edge of the document M has been detected. When the trailing edge sensor 61 detects the trailing edge of the document M, the controller 29 identifies a detection time point T2 that the trailing edge has been detected.

The controller 29 calculates a length L of the document M in the transport direction, on the basis of a time T between the detection time point T1 of the leading edge and the detection time point T2 of the trailing edge, a known distance K between the position PS1 and the position PS2, and a document transport speed S (document transport speed by the feeding roller 34, the transport belt 35, the resist roller 37, the transport rollers 38, the shading rollers 43A and 43B, the first discharge roller 39, and the second discharge roller 48).

For example, the controller 29 calculates the length L of the document M, with an equation "Document length L=distance K+transport speed S×time T" (Equation 1). For example, when the transport speed S is 600 mm/sec., and the distance K is 51.5 mm, the controller 29 calculates the length L as 51.5 mm, when the time T is 0 seconds. When the time T is 0.05 seconds, the controller 29 calculates the length L as 81.5 mm.

The controller 29 compares the length L of the document M, with a prespecified first length threshold 1S. When the length L of the document M is equal to or longer than the first length threshold 1S, the controller 29 sets the switching claw 44 to the posture for guiding the document M to the curved transport route 46, from the common transport route 45. The controller 29 causes the document M to proceed along the curved transport route 46 to the first platen glass 51, pass over the first platen glass 51, and be discharged by the first discharge roller 39 to the first discharge tray 40. The controller 29 causes the CCD sensor 57 to read the image on the surface of the document M through the first platen glass 51, and stores the image data representing the image on the surface of the document M, in the image memory 26. Then the controller 29 causes the image forming device 21 to form the image on the surface of the document M represented by the image data, on the recording sheet P.

In contrast, when the length L of the document M is shorter than the first length threshold 1S, the controller 29 sets the switching claw 44 to the posture for guiding the document M to the linear transport route 47 from the common transport route 45, thereby causing the document M to proceed along the linear transport route 47. The controller 29 causes the second CIS 42 to read the image on the surface of the document M, and stores the image data representing the image on the surface of the document M, in the image memory 26. Then the controller 29 causes the image forming device 21 to form the image on the surface of the document M represented by the image data, on the recording sheet P.

Here, there may be a case where the user operates the GUI displayed on the display device 24, to input the instruction to read the both sides of the document M, before pressing down the start key on the operation device 23 to input the instruction to read the document. In this case, when the operation device 23 accepts the instruction to read the both sides of the document M, the controller 29 causes the document M to proceed along the common transport route 45 and the curved transport route 46. The controller 29 causes the first CIS 41 to read the image on the back face of the document M, and causes the CCD sensor 57 to read the image on the front face of the document M. The controller 29 sequentially stores the image data respectively representing the image of the back face and the image of the front face of the document M, in the image memory 26. Then the controller 29 causes the image forming device 21 to form the image of the back face and the image of the front face of the document M, represented by the image data, on the front face and the back face of the recording sheet P, respectively.

Alternatively, the controller 29 causes the document M to proceed along the common transport route 45 and the linear transport route 47, causes the first CIS 41 to read the image on the back face of the document M, and causes the second CIS 42 to read the image on the front face of the document M. The controller 29 sequentially stores the image data respectively representing the image of the back face and the image of the front face of the document M, in the image memory 26. Then the controller 29 causes the image forming device 21 to form the image of the back face and the image of the front face of the document M, represented by the image data, on the front face and the back face of the recording sheet P, respectively.

The curved transport route 46 is suitable for transporting the document M made of a flexibly bendable thin sheet, of a standard size such as A5, B5, A4, or B4. The linear transport route 47 is suitable for transporting the document M made of a thick paper that is difficult to bend, such as a name card or the like. From another viewpoint, the curved transport route 46 is suitable for transporting the document M that is elongate in the transport direction. The linear transport route 47 is suitable for transporting the document M that is short in the transport direction.

For such reason, the controller 29 calculates the length L of the document M in the transport direction, as described above. The controller 29 operates the switching claw 44 so as to guide the document M from the common transport route 45 to the curved transport route 46, when the length L of the document M is equal to or longer than the first length threshold 1S. When the length L of the document M is shorter than the first length threshold 1S, the controller 29 operates the switching claw 44 so as to guide the document M from the common transport route 45 to the linear transport route 47.

The controller 29 sets the first length threshold 1S to the length equal to a maximum distance between the rollers cited above in the curved transport route 46 (i.e., maximum value of the second clearance). For example, when the distance between the first discharge roller 39 in the curved transport route 46, and the transport roller 38 located upstream of the first discharge roller 39 is the maximum distance, the controller 29 sets the first length threshold 1S to the length equal to the distance between the mentioned rollers. When the length L of the document M is shorter than the first length threshold 1S, the document M is unable to be transported through the section between the first discharge roller 39 and the transport roller 38 upstream thereof. Therefore, the controller 29 operates the switching claw 44 so as to guide the document M from the common transport route 45 to the linear transport route 47.

Figure 8:
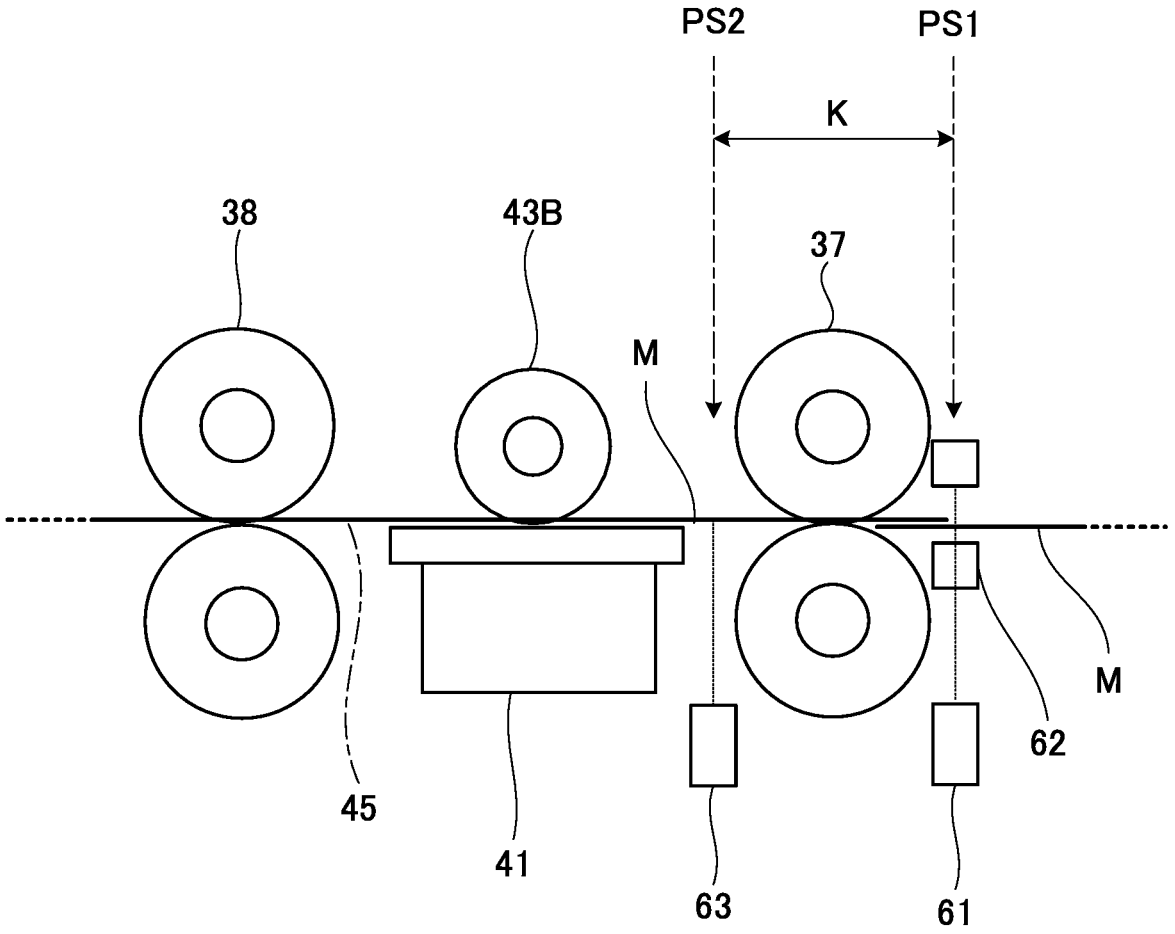
FIG. 8 is a schematic diagram showing a state where multi feed is occurring on the common transport route.

Now, when two sheets of the document M fail to be separated between the transport belt 35 and the regulating roller 36, and the two documents M are transported therebetween, the multi feed occurs. In this case, the trailing edge sensor 61 does not detect the trailing edge of the document M, as shown in FIG. 8. Accordingly, the controller 29 is unable to measure the time T between the detection time point T1 of the leading edge and the detection time point T2 of the trailing edge, on the basis of the detection of the trailing edge by the trailing edge sensor 61, and therefore unable to calculate the length L of the document M in the transport direction.

Figure 9A:
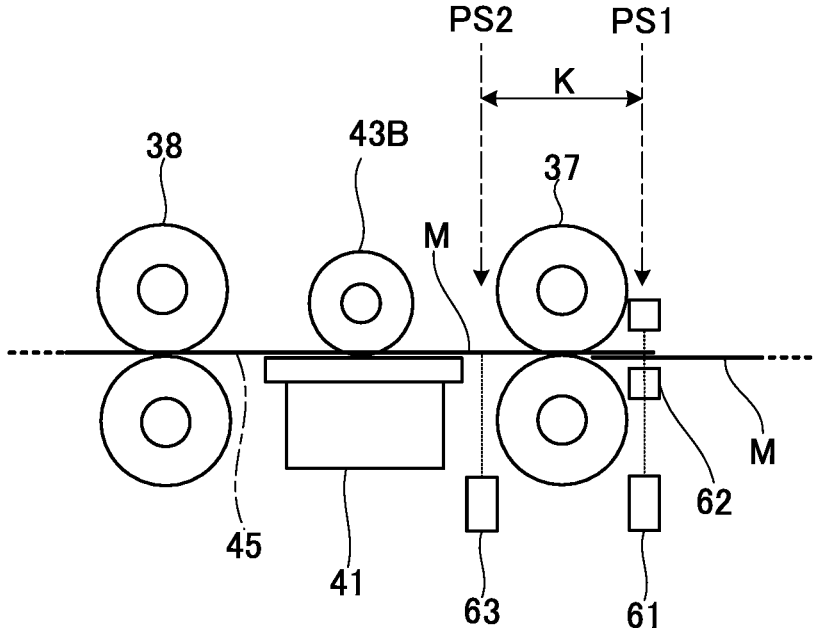
FIG. 9A and FIG. 9B are schematic drawings showing how multi feed is resolved.
Figure 9B:
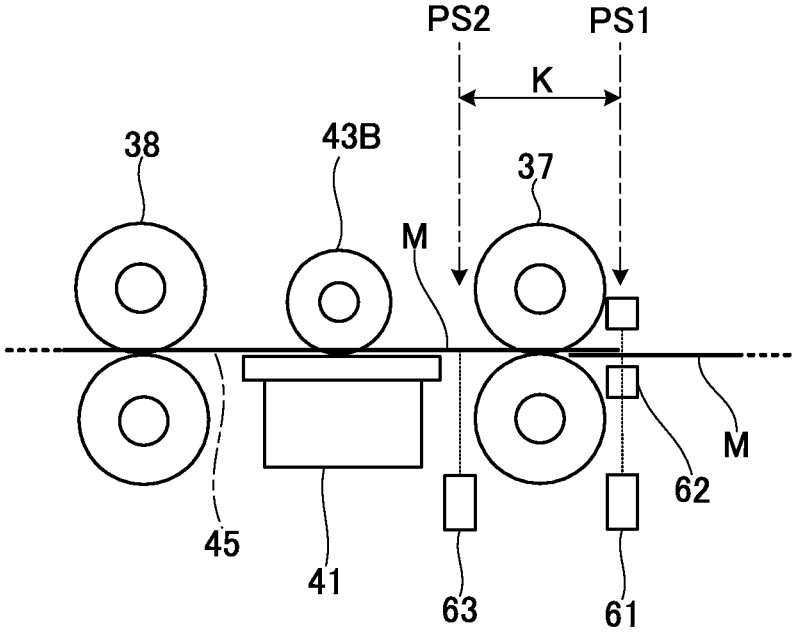

Therefore, when one of the documents M is separated, from the state of multi feed where the two documents M are overlapping, as shown in FIG. 9A and FIG. 9B, the controller 29 identifies the time point that the trailing edge of the one document M has passed the position PS1, so that the state of multi feed has been resolved, in other words a non-detection time point T3 that the detection status of the multi feed sensor 62 has been switched to the non-detection state, as the time point that the trailing edge of the one document M has passed the position PS1.

The controller 29 measures the time T from the detection time point T1 of the leading edge to the non-detection time point T3, and calculates the length L of the document M in the transport direction, with the Equation 1 cited above as "Document length L=distance K+transport speed S×time T", on the basis of the time T that has been measured, the distance K between the position PS1 and the position PS2, and the transport speed S. The controller 29 compares the length L of the document M in the transport direction with the first length threshold 1S, and operates the switching claw 44 so as to guide the document M, to either of the curved transport route 46 and the linear transport route 47.

Figure 10:
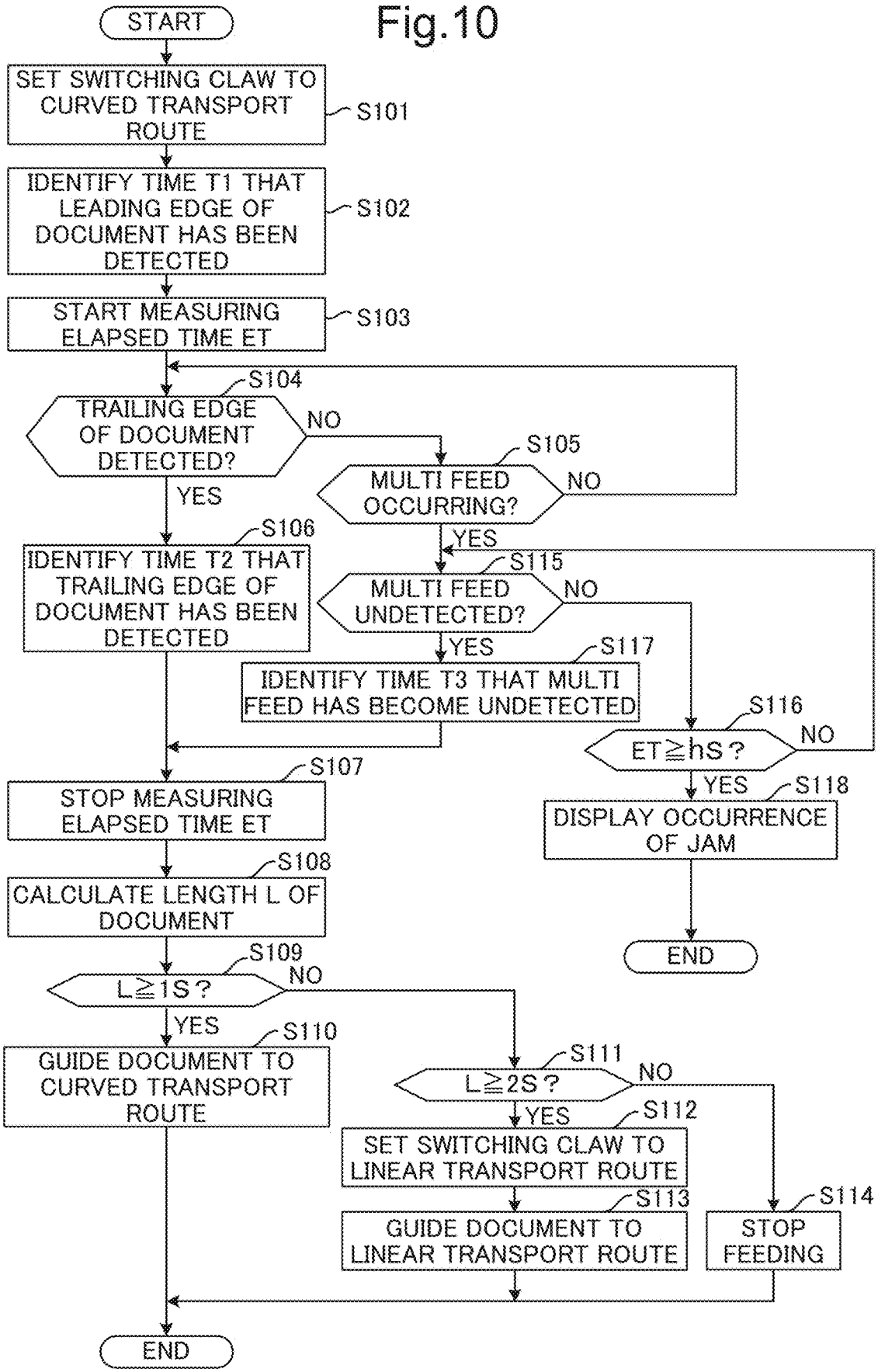
FIG. 10 is a flowchart showing a control process for switching a transport direction.

Referring now to a flowchart shown in FIG. 10, a control process executed by the controller 29, to switch the transport direction of the document M, will be described in detail hereunder. Such process includes identifying the detection time point T1, the detection time point T2, and the non-detection time point T3, calculating the length L of the document M, transporting the document M along either of the curved transport route 46 and the linear transport route 47, and reading the image of the document M.

When the user places the document M on the document tray 33, the second sensor detects the document M on the document tray 33, so that the controller 29 sets the second mode. When the user presses down the start key on the operation device 23, the controller 29 orients the distal end portion of the switching claw 44 obliquely upward, as a default operation, to direct the switching claw 44 toward the curved transport route 46 (step S101). The controller 29 controls the document transport device 31 so as to cause the feeding roller 34 to draw out the document M from the document tray 33, and deliver the document M to the common transport route 45, through between the transport belt 35 and the regulating roller 36.

The leading edge of the document M passes the position PS1 and reaches the position PS2, as shown in FIG. 7A. The CIS position sensor 63 detects the leading edge of the document M, which has reached the position PS2.

When the CIS position sensor 63 detects the leading edge of the document M, the controller 29 identifies the detection time point T1 of the leading edge (step S102). The controller 29 starts to measure an elapsed time ET, from the detection time point T1 of the leading edge (step S103). For example, the controller 29 uses a built-in timer, to measure the elapsed time ET.

When the images of the respective sides of the document M are to be read, the controller 29 causes the first CIS 41 to start to read the image on the back face of the document M, in accordance with the detection time point T1 of the leading edge of the document M.

The controller 29 stands by for the trailing edge sensor 61 to detect the trailing edge of the document M passing the position PS1 (No at step S104), and for the multi feed sensor 62 to detect whether the multi feed of the documents M passing the position PS1 is occurring (No at step S105).

For example, when the trailing edge of the document M passes the position PS1, without the multi feed having been detected as shown in FIG. 7B, the trailing edge sensor 61 detects the trailing edge of the document M, and the multi feed sensor 62 detects that the multi feed of the document M is not occurring.

In the case where the multi feed sensor 62 does not detect the multi feed of the document M (No at step S105), and the trailing edge sensor 61 detects the trailing edge of the document M (Yes at step S104), the controller 29 identifies the detection time point T2 of the trailing edge of the document M (step S106), and stops measuring the elapsed time ET (step S107). The controller 29 acquires the time T from the detection time point T1 of the leading edge to the detection time point T2 of the trailing edge, and calculates the length L of the document M in the transport direction, with the Equation 1 cited above, on the basis of the time T and the distance K between the position PS1 and the position PS2 (step S108).

The controller 29 compares the length L of the document M with the first length threshold 1S (step S109). When the length L of the document M is equal to or longer than the first length threshold 15 (Yes at step S109), the controller 29 keeps the distal end portion of the switching claw 44 oriented obliquely upward, thereby causing the switching claw 44 to guide the document M to the curved transport route 46 (step S110), and causes the CCD sensor 57 of the reading device 32 to read the image on the surface of the document M passing over the first platen glass 51.

In contrast, when the length L of the document M is shorter than the first length threshold 15 (No at step S109), the controller 29 decides whether the length L of the document M is equal to or longer than a prespecified second length threshold 2S (step S111). The second length threshold 2S is shorter than the first length threshold 15, and equal to the maximum distance between the rollers on the linear transport route 47 (maximum value of the first clearance). When the length L of the document M is equal to or longer than the second length threshold 2S, the controller 29 can transport the document M along the linear transport route 47. When the length L of the document M is shorter than the second length threshold 2S, the controller 29 is unable to transport the document M along the linear transport route 47.

For example, upon deciding that the length L of the document M is equal to or longer than the second length threshold 2S (Yes at step S111), the controller 29 orients the distal end portion of the switching claw 44, in the horizontal direction (step S112). Thus, the controller 29 causes the switching claw 44 to guide the document M to the linear transport route 47, and causes the second CIS 42 to read the image on the surface of the document M (step S113).

In contrast, upon deciding that the length L of the document M is shorter than the second length threshold 2S (No at step S111), the controller 29 causes the document transport device 31 to stop transporting the document M, and causes the display device 24 to display an error message (e.g., notifying that the document is too small to transport) on the screen (step S114).

In addition, when the multi feed of two documents M is occurring, the trailing edge sensor 61 does not detect the trailing edge of the document M as shown in FIG. 8 (No at step S104), and the multi feed sensor 62 detects the multi feed of the document M (Yes at step S105).

In such a case, the controller 29 stands by for the multi feed sensor 62 to stop detecting the multi feed of the documents M passing the position PS1 (No at step S115). The controller 29 also stands by for the elapsed time ET, started to be measured at step S103, to reach a prespecified threshold hS (No at step S116).

It will be assumed here that, in the mentioned situation, one of the two documents overlapping with each other is separated, and the trailing edge of such one document M has passed the position PS1, as shown in FIG. 9A and FIG. 9B. In this case, when the multi feed sensor 62 detects that the multi feed of the documents M is no longer occurring, without the trailing edge sensor 61 having detected the trailing edge of the document M, the detection status of the multi feed sensor 62 is switched to the non-detection state.

When the detection status of the multi feed sensor 62 is switched to the non-detection state (Yes at step S115), before the elapsed time ET reaches the threshold hS (No at step S116), the controller 29 identifies the non-detection time point T3 that the multi feed of the documents M has become undetected (step S117), and stops measuring the elapsed time ET (step S107). The controller 29 acquires the elapsed time ET from the detection time point T1 of the leading edge to the non-detection time point T3, as the time T, and calculates the length L of the document M in the transport direction, with the Equation 1 cited above, on the basis of the time T acquired as above, the distance K between the position PS1 and the position PS2, and the transport speed S (step S108).

When the length L of the document M is equal to or longer than the first length threshold 1S (Yes at step S109), the controller 29 keeps the distal end portion of the switching claw 44 oriented obliquely upward, thereby causing the switching claw 44 to guide the document M to the curved transport route 46 (step S110). Then the controller 29 causes the CCD sensor 57 of the reading device 32 to read the image on the surface of the document M passing over the first platen glass 51.

In contrast, when the length L of the document M is shorter than the first length threshold 15 (No at step S109), the controller 29 decides whether the length L of the document M is equal to or longer than the second length threshold 2S (step S111).

Upon deciding that the length L of the document M is equal to or longer than the second length threshold 2S (Yes at step S111), the controller 29 orients the distal end portion of the switching claw 44, in the horizontal direction (step S112), thereby causing the switching claw 44 to guide the document M to the linear transport route 47 (step S113). Then the controller 29 causes the second CIS 42 to read the image on the surface of the document M.

In contrast, upon deciding that the length L of the document M is shorter than the second length threshold 2S (No at step S111), the controller 29 causes the document transport device 31 to stop transporting the document M, and causes the display device 24 to display the error message (e.g., notifying that the document is too small to transport) on the screen (step S114).

Here, upon deciding that the elapsed time ET, started to be measured at step S103, has reached the threshold hS (Yes at step S116), without the detection status of the multi feed sensor 62 having been switched to the non-detection state (No at step S115), the controller 29 decides that paper jam has occurred, and causes the document transport device 31 to stop transporting the document M. Then the controller 29 causes the display device 24 to display an error message based on the occurrence of the paper jam (e.g., notifying that the multi feed of the documents is occurring), on the screen (step S118).

The controller 29 sets the threshold hS, for example, to a value equal to or larger than the value obtained by dividing the length of the common transport route 45 by the transport speed S. In this embodiment, therefore, the document M is guided to the curved transport route 46 by the distal end portion of the switching claw 44 oriented obliquely upward, when the paper jam occurs.

Now, in the case of the aforementioned existing image reading apparatus, the switching device is configured to guide the document to the second transport route, which is linear, when the thickness of the document detected by the thickness sensor is considerably thick, and the document is stiff. However, when a plurality of thin documents are transported in a stacked state (i.e., when the multi feed of the documents is occurring), the thickness sensor simply detects that the document being transported is thick, and the plurality of documents are transported as they are, without the multi feed being resolved.

As described above, the curved transport route is suitable for transporting the document elongate in the transport direction, and the linear transport route is suitable for transporting the document that is short in the transport direction. Accordingly, the length of the document in the transport direction may be detected, instead of the thickness of the document, and the transport route may be switched depending on the length of the document. In this case, however, when the multi feed of the documents occurs, the length of the document may fail to be accurately detected.

According to the foregoing embodiment, in contrast, the detection time point T1 that the CIS position sensor 63 has detected the leading edge of the document M, the detection time point T2 that the trailing edge sensor 61 has detected the trailing edge of the document M, and the non-detection time point T3 that the detection status of the multi feed sensor 62 has been switched to the non-detection state, are identified, and the length L of the document M is calculated, on the basis of these time points T1, T2, and T3. Therefore, the length L of the document M can be accurately acquired, irrespective of whether the multi feed of the documents M is occurring, and the document M can be properly guided to either of the curved transport route 46 and the linear transport route 47, according to the length of the document M, so that the occurrence of paper jam can be prevented. In other words, with the arrangement according to the foregoing embodiment, the length of the document M in the transport direction can be accurately detected, and the transport route can be properly selected according to the detected length of the document M, so that the document M can be transported along the appropriate transport route, without the risk of transporting the documents M overlapping with each other.

In addition, the CIS position sensor 63, the trailing edge sensor 61, and the multi feed sensor 62 are employed to execute the foregoing control according to the embodiment, which eliminates the need to employ additional parts, thereby suppressing an increase in the number of parts and the production cost.

In the foregoing embodiment, further, although the position for detecting the trailing edge of the document M by the trailing edge sensor 61, and the position for detecting the multi feed of the documents M by the multi feed sensor 62 are both set at the same position PS1, these detection points may be shifted from each other. In this case, the controller 29 calculates the length L of the document M in the transport direction, with the distance between the position for detecting the trailing edge of the document M by the trailing edge sensor 61, and the position for detecting the leading edge of the document M by the CIS position sensor 63, set as the distance K. Alternatively, the controller 29 calculates the length L of the document M in the transport direction, with the distance between the position for detecting the multi feed of the documents M by the multi feed sensor 62, and the position for detecting the leading edge of the document M by the CIS position sensor 63, set as the distance K.

The disclosure may be modified in various manners, without limitation to the foregoing embodiment. Further, the configurations and processings of the foregoing embodiment, described with reference to FIG. 1 to FIG. 10, are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. An image reading apparatus comprising:

a document tray;

a common transport route;

a curved transport route and a linear transport route branched from the common transport route;

a switching device provided at a branch point between the curved transport route and the linear transport route;

a document transport device that draws out a document from the document tray on which the document is placed, transports the document along the common transport route, and delivers the document transported along the common transport route to one of the curved transport route and the linear transport route, with the switching device;

a first image sensor that reads an image of the document being transported along the curved transport route;

a second image sensor that reads an image of the document being transported along the linear transport route;

a trailing edge detector provided on the common transport route, to detect a trailing edge of the document;

a multi feed detector provided on the common transport route, to detect whether multi feed of documents is occurring;

a leading edge detector provided on the common transport route, at a position downstream of the trailing edge detector and the multi feed detector in a transport direction of the document, to detect a leading edge of the document; and a controller including a processor, and configured to (i) determine, when the processor executes a control program, a length of the document in the transport direction, on a basis of a detection time point that the leading edge detector has detected the leading edge of the document, a detection time point that the trailing edge detector has detected the trailing edge of the document, and a non-detection time point that a detection status of the multi feed detector has been switched to a non-detection state, and (ii) guide the document to one of the curved transport route and the linear transport route from the common transport route, according to the length of the document in the transport direction, by controlling an action of the switching device.

2. The image reading apparatus according to claim 1, wherein the controller measures a first time from the detection time point of the leading edge of the document, to the non-detection time point, and determines the length of the document in the transport direction, on a basis of the first time measured, and a distance from a detection position where the multi feed detector has detected the multi feed of the documents, to a detection position where the leading edge detector has detected the leading edge of the document.

3. The image reading apparatus according to claim 2, wherein the controller measures a second time from the detection time point of the leading edge of the document to the detection time point of the trailing edge of the document, and determines the length of the document in the transport direction, on a basis of the second time measured, and a distance from a detection position where the trailing edge detector has detected the trailing edge of the document, to a detection position where the leading edge detector has detected the leading edge of the document.

4. The image reading apparatus according to claim 2, wherein the linear transport route includes a plurality of first rollers that transport the document, the curved transport route includes a plurality of second rollers that transport the document, and a maximum distance between the first rollers is shorter than a maximum distance between the second rollers.

5. The image reading apparatus according to claim 4, wherein the controller controls the switching device so as to guide the document from the common transport route to the curved transport route, when the length of the document in the transport direction is equal to or longer than the maximum distance between the second rollers, and controls the switching device so as to guide the document from the common transport route to the linear transport route, when the length of the document in the transport direction is shorter than the maximum distance between the second rollers.

6. The image reading apparatus according to claim 5, wherein the controller causes the document transport device to stop transporting the document, when the length of the document in the transport direction is shorter than the maximum distance between the first rollers.

7. The image reading apparatus according to claim 2, wherein the controller measures an elapsed time from the detection time point of the leading edge of the document, and causes the document transport device to stop transporting the document, when the elapsed time reaches a prespecified threshold, without the trailing edge of the document having been detected by the trailing edge detector, and without the detection status of the multi feed detector having been switched to the non-detection state.

8. The image reading apparatus according to claim 1, wherein the trailing edge detector and the multi feed detector are located such that a detection position where the trailing edge detector detects the trailing edge of the document, and a detection position where the multi feed detector detects the multi feed of the documents coincide with each other.

9. An image forming apparatus comprising:

the image reading apparatus according to claim 1; and an image forming device that forms the image of the document read by the image reading apparatus, on a recording sheet.

* * * * *